US011148194B2

(12) United States Patent
Hetke

(10) Patent No.: US 11,148,194 B2
(45) Date of Patent: Oct. 19, 2021

(54) CASTING SYSTEM

(71) Applicant: Adolf Hetke, Brooklyn, MI (US)

(72) Inventor: Adolf Hetke, Brooklyn, MI (US)

( * ) Notice: Subject to any disclaimer, the term of this patent is extended or adjusted under 35 U.S.C. 154(b) by 53 days.

(21) Appl. No.: 15/976,305

(22) Filed: May 10, 2018

(65) Prior Publication Data

US 2019/0344337 A1 Nov. 14, 2019

(51) Int. Cl.

| | |
|---|---|
| ***B22D 35/04*** | (2006.01) |
| ***B22D 18/04*** | (2006.01) |
| ***B22D 27/00*** | (2006.01) |
| ***B22D 27/08*** | (2006.01) |
| ***B22D 30/00*** | (2006.01) |

(52) U.S. Cl.

CPC ..... *B22D 35/04* (2013.01); *B22D 18/04* (2013.01); *B22D 27/003* (2013.01); *B22D 27/08* (2013.01); *B22D 30/00* (2013.01)

(58) Field of Classification Search

CPC ..... B22D 35/04; B22D 18/04; B22D 27/003; B22D 27/08; B22D 30/00; B22D 33/00; B22D 33/02

See application file for complete search history.

(56) References Cited

U.S. PATENT DOCUMENTS

| | | | | |
|---|---|---|---|---|
| 2,359,524 | A * | 10/1944 | Lane | B22D 18/06 164/259 |
| 3,823,760 | A | 7/1974 | Bloomfield et al. | |
| 4,633,930 | A | 1/1987 | Behrens | |
| 4,938,274 | A | 7/1990 | Iwamoto et al. | |
| 5,163,500 | A * | 11/1992 | Seaton | B22D 18/04 164/119 |
| 5,355,934 | A * | 10/1994 | Uozumi | B22D 18/06 164/255 |
| 6,247,521 | B1 | 6/2001 | Kawai et al. | |
| 6,932,146 | B2 | 8/2005 | Nichol et al. | |
| 7,896,059 | B2 | 3/2011 | Hetke | |
| 2001/0002617 | A1 | 6/2001 | Schofield et al. | |
| 2003/0056929 | A1 | 3/2003 | Staley, Jr. | |

(Continued)

FOREIGN PATENT DOCUMENTS

| | | | |
|---|---|---|---|
| JP | 61209761 | A | 9/1986 |
| JP | 01104457 | A * | 4/1989 |

(Continued)

OTHER PUBLICATIONS

International Search Report of PCT/US2019/030839.

*Primary Examiner* — Kevin P Kerns
*Assistant Examiner* — Steven S Ha
(74) *Attorney, Agent, or Firm* — Fishman Stewart PLLC

(57) ABSTRACT

A casting system and process employs sealed lightweight mold segments that are assembled into a fixture that serves as a mold transportation device that is delivered via a mold line to a production line roll-over system which performs as a metal pouring station. This system may be employed in sand, semi-permanent and permanent casting environments. The fixture is pressurized with He, inverted by the roll-over system, then connected to a low-pressure furnace where metal pouring begins while maintaining pressurized He in the mold cavity. A counter-gravity delivery system allows the low-pressure furnace to deliver molten lightweight material that is free from oxides and dissolved hydrogen gas into the mold cavity.

15 Claims, 9 Drawing Sheets

(56) References Cited

U.S. PATENT DOCUMENTS

| | | | | |
|---|---|---|---|---|
| 2005/0126740 | A1* | 6/2005 | Wust | B22D 17/14<br>164/457 |
| 2008/0264597 | A1 | 10/2008 | Harada et al. | |
| 2008/0308249 | A1 | 12/2008 | Hetke | |

FOREIGN PATENT DOCUMENTS

| | | | | |
|---|---|---|---|---|
| JP | 02274366 | A | * | 11/1990 |
| JP | 2009/314318 | A | | 12/1997 |
| JP | 2011192544 | A | | 9/2011 |
| JP | H-11192544 | A | | 9/2011 |
| JP | 2018/065168 | A | | 4/2018 |
| WO | WO-2007/079482 | A2 | | 7/2007 |
| WO | WO-2017/085765 | A1 | | 5/2017 |

* cited by examiner

CASTING SYSTEM

BACKGROUND

The automotive and aerospace industries continue to drive innovation in a variety of technological fields, including that of the cast metals industry. Continual market pressure to significantly reduce cast component cost and weight while increasing performance has highlighted the need for geometric design flexibility and the merging of value-added features into complex engineered castings. This focus gave birth to Precision Sand Casting [PSC] for aluminum engine blocks and cylinder heads as developed by Cosworth Castings and other companies by using zircon dry sand molding technology. Dry sand molding, combined with sand core technology for intricate internal casting features is a practical and flexible approach for "Core-Pack Molding" in the production of aluminum castings. This technology is cost effective and complex-design friendly for a high-volume production foundry process. PSC technology is being utilized for the production of Premium Quality Aluminum Engine Blocks for the North American Automotive Industry.

The automotive industry is continuously demanding reduction of vehicle weight, coupled with significant reduction in overall manufacturing product and process costs. There is a need to address this pressing demand for weight and cost reduction, for example, in engine block and powertrain components. Sand molding technology and low-pressure mold filling technology could be enhanced by unique features to achieve cost reduction and premium quality aluminum metallurgy.

The manufacturing industry is also demanding an improved casting process that can be used in low to medium volume production facilities. For example, in the foundry environment, there is a demand to provide a casting system that is flexible for small production runs to generate prototype sample parts. There is also a demand to then utilize that same production process for larger scale productions runs as well. Thus, a flexible casting process that is operable for prototype runs as well as production runs is in demand. Cost savings can result from such an improved casting system.

Overview

The present disclosure contemplates a casting system and process employing super lightweight mold segments assembled into a mold fixture support system to serve as a mold transportation device or fixture that is delivered via a mold line to a production line roll-over support system which performs as a pouring station. Once the mold fixture is secured in the roll-over system, it is then connected to a low-pressure furnace fill nozzle where metal pouring begins. Using a counter-gravity delivery system, the low-pressure furnace delivers premium quality molten lightweight material, such as aluminum, that is free from oxides and dissolved hydrogen gas into the mold cavity.

To make the mold cavity free from oxides, the permeable sand is saturated with Helium gas [He] which facilitates rapid solidification of the molten aluminum, thus influencing very fine dendrite formation. To accomplish this, the cavity may be flushed with He before metal is introduced in to the cavity. The metallurgical impact on the aluminum is reflected in measurable [between 50% and 100%] mechanical property improvements. The light weight precision sand mold segments are matched with a high-productivity pouring station, which is possible because of the He mold environment and counter-gravity pouring system. Casting solidification is then accomplished offline away from the pouring station, which in turn frees up the pouring station so that it can accept the next mold fixture in line for the next rapid pouring cycle.

The sand mold construction with metal chills strategically located in casting areas enhances solidification properties. He gas, because of its unique qualities of thermal conductivity [six times that of air], significantly improves the efficiency of the chill as well as the surrounding sand to molten aluminum contact areas. Further, the He gas can be introduced into the sand mold via a manifold system that targets the mold cavity for maximum effectiveness.

This disclosure provides at least three improved mold configurations taking advantage of the He cooling gas environment as deployed in the present casting system. They are:

1. Total Encapsulation of sand mold via a seal using an elastic vacuum-like bag that is sealed to create an He gas environment with an entry valve as well as degassing valve for pressure control, negative as well as positive.
2. Partial encapsulation of outer sand mold surface where the circumference of mold surface is encapsulated [like a mold configuration is a box]. The top and bottom of the mold surface remains unsealed. Manifold style introduction of He is delivered below the casting cavity causing the He to flow up-ward due to its low density and thus flush the mold of Oxygen [$O_2$] and to cool the molten material. This concept is compatible with the roll-over type casting systems.
3. Mold in Chamber Environment where sand mold with an He manifold is connected via chamber valve connection to an outside He source to control flow and pressure, as well as vacuum if desired, for specific casting geometry. This system can be applied to an indexing low pressure pouring molding system.

DETAILED DESCRIPTION OF THE DISCLOSURE

Figure 1:
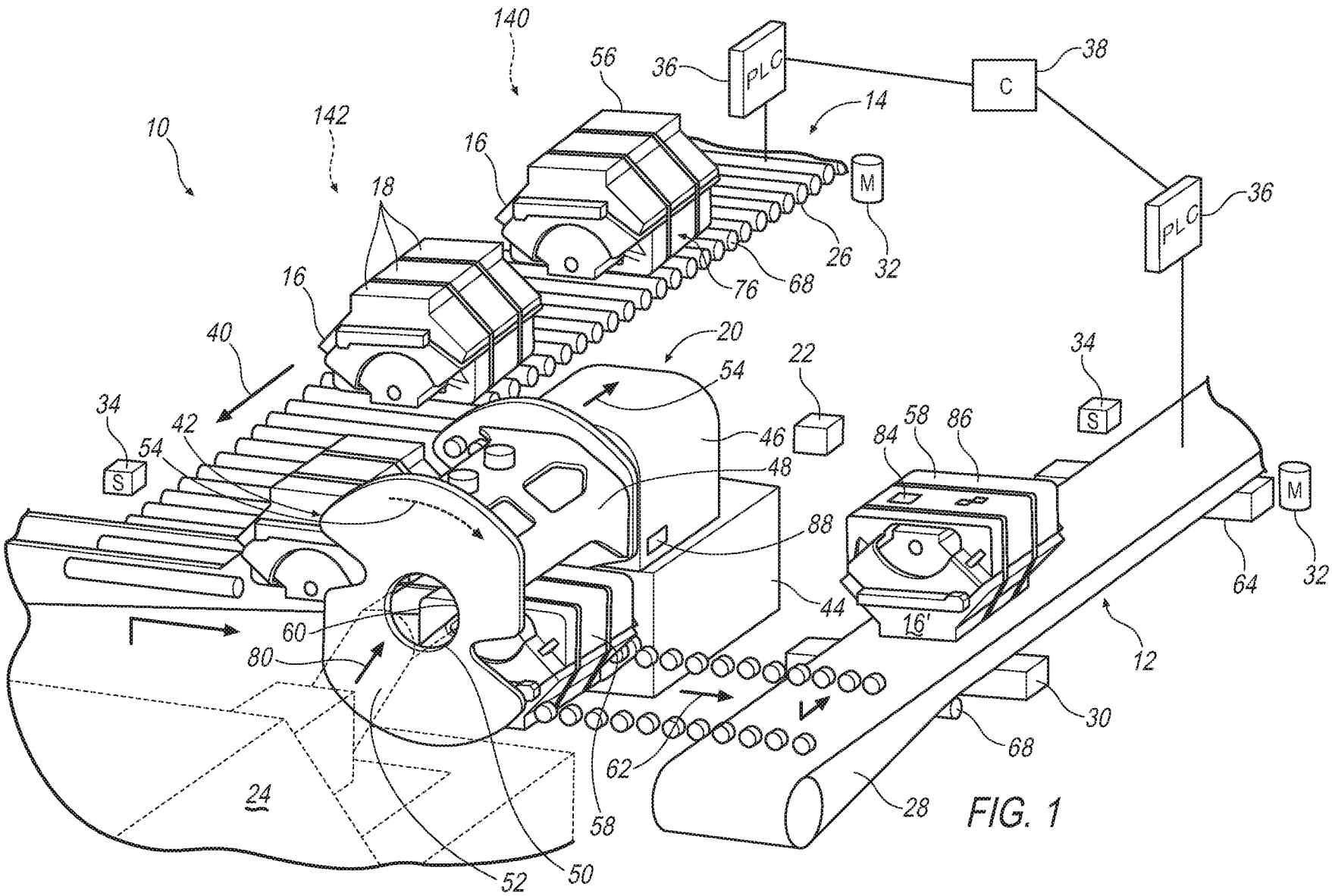
FIG. 1 is a schematic diagram of a Casting System for manufacturing metal castings, showing a mold being loaded in to a roll-over system.

The present casting system 10 can be deployed in a foundry prototype or hi-production facility where very thin, lightweight sand cores for Core-Pack Molding can be used in the production of light metal castings such as, but not limited to, aluminum and magnesium. The lightweight sand cores can be produced with conventional core machines and core sand binder systems. One improvement is in the assembly of the lightweight core segments with shape specific geometries into a core pack, and subsequently shrink-wrapped, to form a seal of the core pack to keep the assembly intact dimensionally while being counter-gravity filled with molten aluminum. The improved lightweight core pack can also be supported within a fixture and then sealed via shrink wrap, or some other method, to achieve a self-contained mold environment that can be flushed with an inert cooling gas, such as, but not limited to, Helium to significantly improve the molten metal and mold heat transfer characteristics. In addition to keeping the core pack assembly intact, the shrink wrap and/or other techniques create a self-contained environment that can be designed to allow for a vacuum attachment that will draw a vacuum on the mold cavity while being filled with molten metal. The slight vacuum will facilitate the removal of core gases as well as allow for the flushing of cooling gases and the removal of heat from the casting while it solidifies.

Helium cooling gas is a preferred gas for the present casting system because of its physical characteristics compared to air or any other inert gas. Helium is inert and has a density seven times lower than air, with thermal conductivity properties six times that of air. Helium has three properties which play roles in influencing the present aluminum casting system. In particular, Helium gas is inert, it has a low density, and it has attractive thermal conductivity characteristics. Taken individually, an inert gas mold cavity environment allows for rapid mold filling without the risk of metal oxidation and resultant casting defects. Such performance can result in faster cycle times, which improves production output per hour. The low-density gas will be pushed out of the mold cavity through the permeable sand mold while the metal enters the mold with far less resistance; thus facilitating thin-wall capability when compared to air. This results in smoother and quicker mold fill times, all while using thinner sand mold walls. And finally, the improved thermal conductivity will enhance the solidification process and significantly improve the efficiency of the metal chill to drive directional metal solidification and improve aluminum metallurgy. This also results in faster cure times which translates in to increased production output per hour for a given pour line. The resulting system provides high production cycle rates due to the high metal fill rate. It also provides improved metal solidification rates resulting in improved microstructure characteristics, improved mechanical properties and thermal fatigue resistance. The present system is further flexible in that it can be used with commercial materials, such as aluminum alloys.

The present sand mold cooling concept is operable to affect the metallurgical properties of aluminum. Such concepts may be applicable to Permanent and Semi-Permanent (hard mold tooling) Aluminum Casting Process as well. The impact of a Helium cooling gas which is inert, has low density and is highly heat conductive, will yield similar results in hard mold tooling. The cooling gas may be introduced into the mold cavity and be targeted on specific areas of the resulting casting. Hard tooling is typically vented to allow core gases and expanding air in the mold cavity to escape—the same venting concept can be applied in reverse to introduce helium gas into the mold cavity. The cooling gas has a positive impact on the solidification characteristics of the aluminum thus achieving a metallurgical microstructure of very low Secondary Dendrite Arm Spacing—higher strength and ductility. Productivity is also improved because of the solidification rate of the cast molten aluminum. Thus, the present disclosure may be applied to sand mold casting, permanent mold casting, and semi-permanent mold casting environments. For discussion purposes only, the sand mold casting process and systems are presented in detail below.

Referring now to the figures, FIG. 1 discloses a schematic diagram of one example of a sand molding casting system 10 for manufacturing metal castings 12 using a low-pressure casting environment deploying an anti-gravity fill system. The casting system 10 includes a transport system 14, a fixture 16 loaded with mold segments 18, a roll-over fill station 20, an inert gas source system 22, and a furnace 24. The transport system 14 includes a first portion 26 and a second portion 28 that may also be considered a cooling conveyor. Chillers 30 may be deployed near and or around the perimeter of the second portion 28 of the transport system 14 to aid in the cooling of the mold fixture 16 once it has left the roll-over fill station 20.

The transport system 14 includes motors 32, sensors 34, and PLCs 36 for controlling the operation of the casting system 14. The PLCs 36, in turn, may communicate with a main computer 38 located remotely in the foundry or elsewhere for controlling and overseeing the production environment at a given facility. It will be appreciated that the motors 32, sensors 34, and PLC 36 may be located at numerous locations within the casting system 10 and they may be operable to communicate with each other in series and/or in parallel in order to effectuate the desired performance and production output. The first portion 26 is operable to motivate a plurality of fixtures 16 from an assembly area (not shown), along a path 40, and then deliver the fixture 16 to a receiving or inlet area 42 of the roll-over station 20. The operation of each fixture 16 along the path 40 of the first portion 26 is controlled by the PLC 36. For example, the sensor 34 may sense when a fixture 16 has entered the inlet area 42, thus allowing the next available fixture 16 to advance along the casting system 10.

The roll-over station 20 is the mold pouring station for the casting system 10 and includes the inlet area 42, a base 44, a head 46 with an indexing or rotating turret 48 that is connected to the base 44, and a nozzle inlet portion 50 for communicating with a furnace nozzle 52. The rotating turret 48 is operable to index axially in the direction of arrow 54 relative to the base 44. This action allows the turret 48 to index relative to the furnace nozzle 52 during mold filling operations. For example, during mold fill operations, the turret 48 is extended outwards towards the furnace nozzle 52 so as to allow flow of the molten material such as aluminum in to the sand mold segments 18. Once the mold is full, metal flow is terminated, which then permits the rotating turret 48 to axially retract in the direction of arrow 54 so as to permit the furnace nozzle 52 to disconnect from the fixture 16.

The roll-over station 20 is operable to rotate in the direction of arrow 54 for the purpose of advancing the fixture 16 from an upright position 56 to an inverted position 58. The fixture 16 enters the inlet 42 in the upright position 56, is secured via clamping mechanism 60, and then is inverted 180 degrees to the inverted position 58 as is shown in FIG. 1. The rotating turret 48 then locks into place, which secures the fixture in the inverted position 58 during the He gas fill and the metal pour steps of the operation. The roll-over station 20 is operable to then advance the fixture in the direction of arrow 62 to the second portion 28 of the transport system 14, where it is then cooled via coolers 30.

Once cooled, the fixture enters a shake-out station 62 where the formed casted part 12 is then removed from the fixture 16. The fixture is then repurposed for later re-use.

The second portion 28 of the transport system 14 includes rollers 68, similar to the rollers 68 on the first portion 26, for supporting and advancing the inverted fixture 16'. The second portion 28 includes motors 32, sensors 34, and a PLC 36, which is in turn connected 70 via a communication link to the main computer 38. It will be appreciated that the PLCs 36 could be connected using various telecommunication methods, for example blue tooth, near field proximity, or other type methods. One or more chillers 30 may be placed along the path of the second portion 28 so as to effectuate cooling characteristics of the metal in the mold segments 18.

Figure 2:
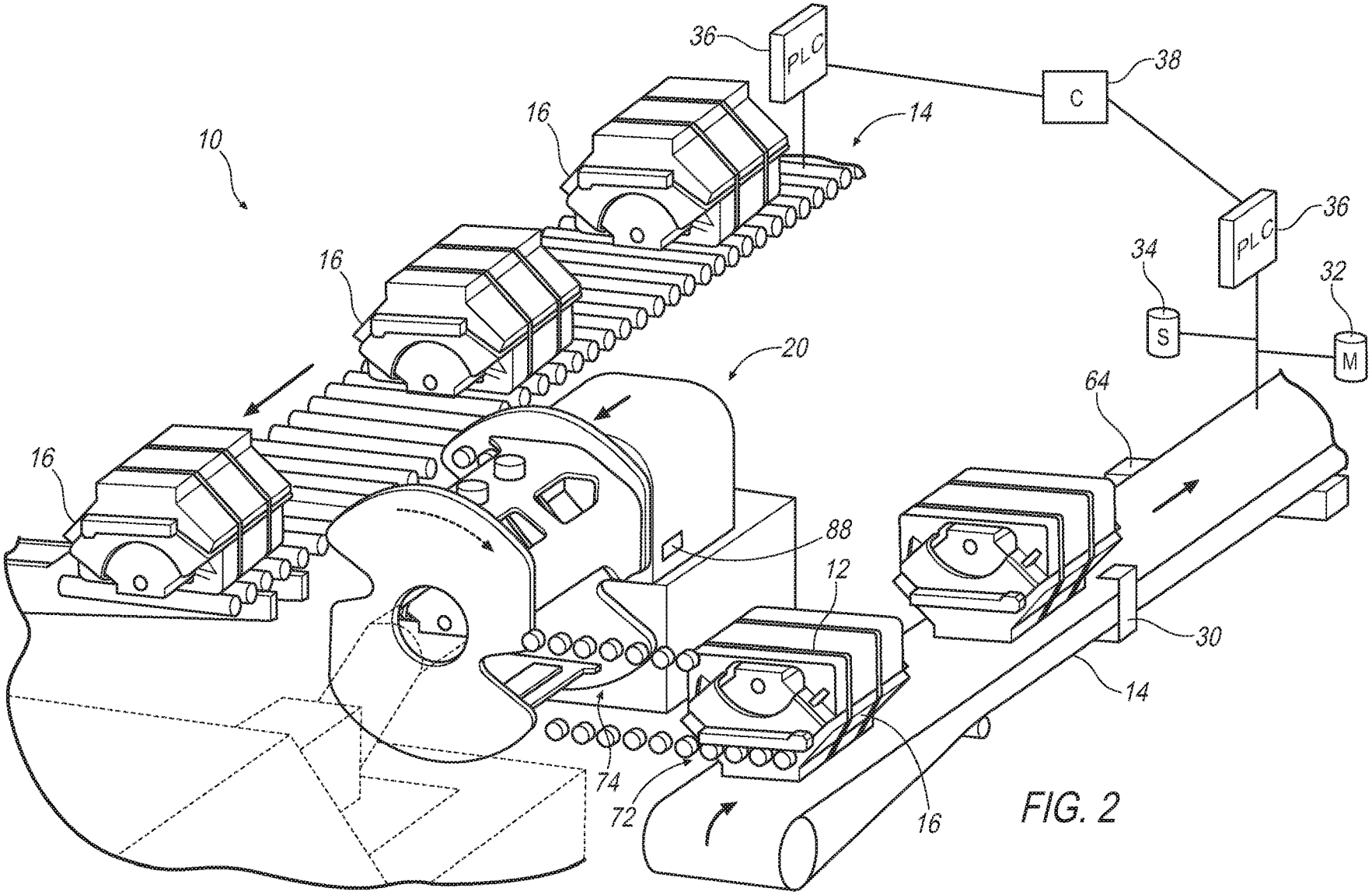
FIG. 2 is the schematic diagram of the Casting System shown in FIG. 1, showing a mold leaving the roll-over system after having been filled with molten material.

FIG. 2 discloses a schematic diagram of the Casting System 10 depicted in FIG. 1, showing the mold fixture 16' exiting the roll-over station 20 after the mold fill step has been completed. A plurality of mold fixtures 16 are stationed along the transport system 14 in preparation to be introduced to the roll-over fill station 20. Here the roll-over station 20 has just completed a fill cycle and a casted part or casting 12 has been formed and is shown exiting 72, the outlet 74 of the roll-over station 20. The fixture 16' advances towards the transport system 14 and is shown inverted as that is the orientation of the fixture 16' when it exits from the roll-over station 20. This permits the anti-gravity metal fill process to be accomplished.

Figure 3A:
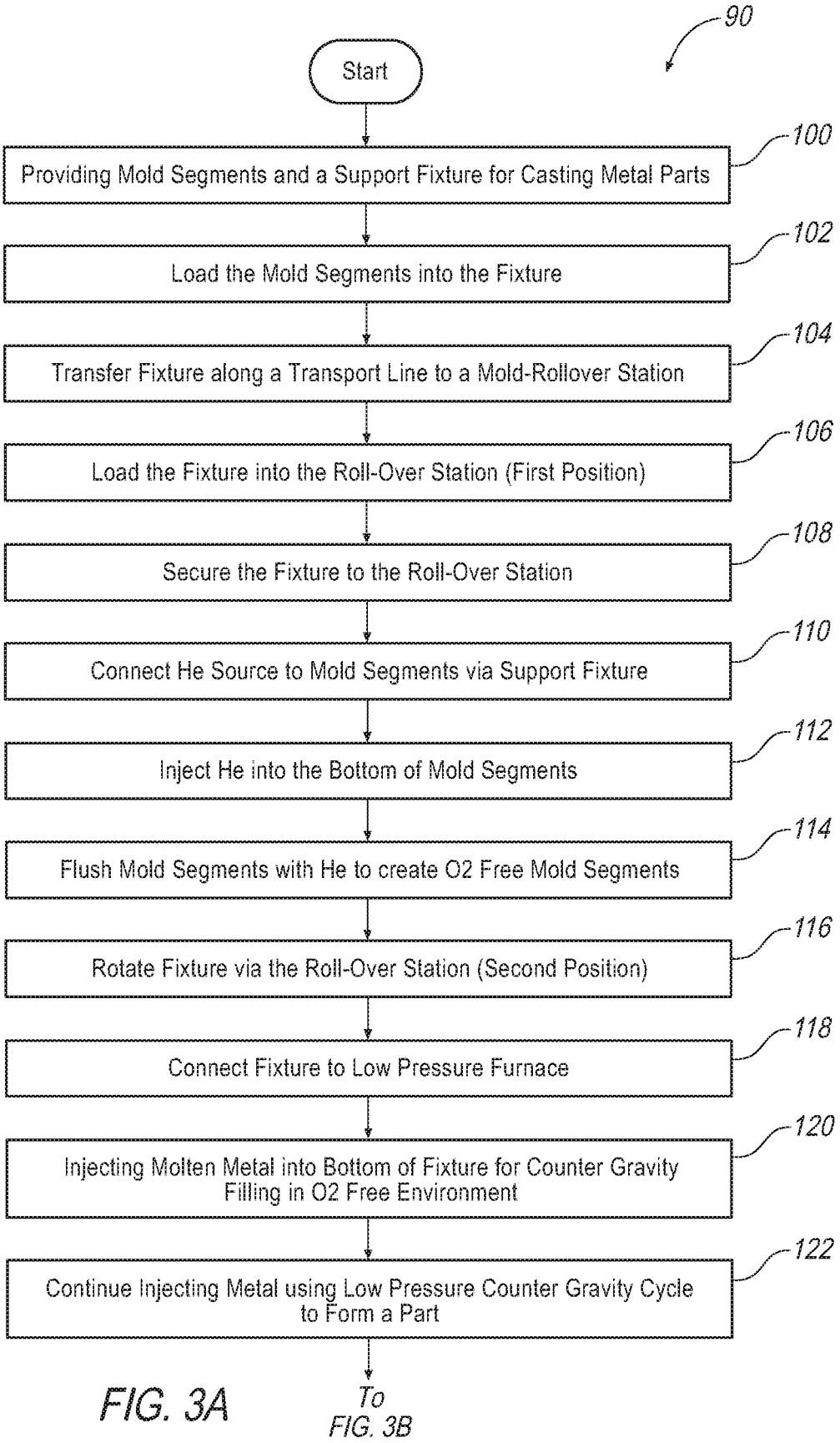
FIGS. 3A-B are a flow diagram of the method of operating the Casting System shown in FIGS. 1 and 2.
Figure 3B:
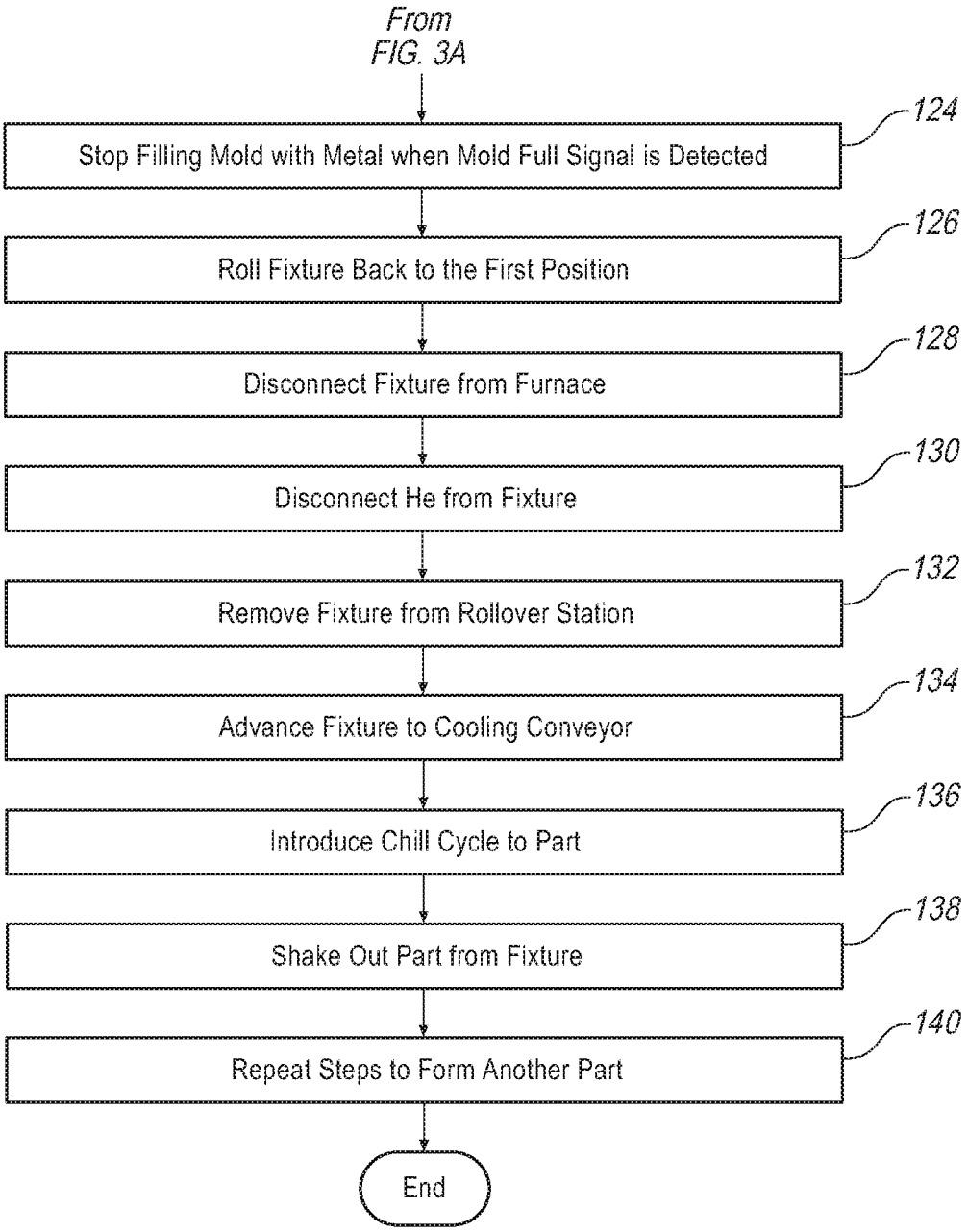

FIGS. 3A and 3B disclose an exemplary casting flow diagram or process 90 illustrating one example of a method of manufacturing a casting 12 using the casting system 10 that is depicted in FIG. 1. It will be appreciated that while the method presented discusses employing He as the inert gas, other inert gasses such as $N_2$, or others, are contemplated by this disclosure. Further, the method 90 of operating the casting system 10 may include fewer or more of the following steps. This is but one example of how the method of operation could be contemplated.

1. Providing mold segments and a support fixture for casting metal parts.
2. Loading the mold segments into the fixture.
3. Transferring fixture along a transport line to a mold roll-over station.
4. Loading fixture into the roll-over station (first position).
5. Securing fixture to the roll-over station.
6. Connecting He source to mold segments.
7. Injecting He into bottom of mold segments.
8. Flushing mold segments with He to create $O_2$-free mold segments.
9. Rotating fixture via the roll-over station (second position).
10. Connecting fixture to a low pressure furnace.
11. Injecting molten metal into bottom of fixture for counter-gravity filling in an $O_2$-free environment.
12. Continuing to inject metal using low-pressure, counter-gravity cycle to form a part.
13. Stopping fill of mold with metal when mold full signal is detected.
14. Rolling fixture back to the first position.
15. Disconnecting fixture from furnace.
16. Disconnecting He source from fixture.
17. Removing fixture from roll-over station.
18. Advancing fixture to cooling conveyor.
19. Introducing chill cycle to part.
20. Shaking out part from fixture.
21. Repeating steps to form another part.

The method of casting 90 may begin with step 100, which is providing mold segments and a support fixture for casting metal parts, may include the mold segments 18 being individual molds that are aligned in segments such that they can be encapsulated and held in place by the fixture 16 during the molding process. After the casting process is complete, the mold segments are destroyed during the shake-out process so as to separate the casted part 12 from the fixture 16'. The fixture in turn can be reused for another mold cycle by installing new mold segments 18. It will be appreciated that based on the design of the casting part 12 to be manufactured, that a single segment 18 or segments aligned in different fashions may be employed.

The next step 102 is loading mold segments 18 into the fixture 16, and this step may include inserting a plurality of individual segments 18 which collectively form the mold 76. This step can be performed off-line and in a staging area.

The next step 104 is to transfer the fixture 16 along a transport line 14 to a mold roll-over station 20, where molten material is introduced to the mold 76. The fixture transfer process may be controlled by the main computer 38, which in turn my have human interface for selectively controlling the operations.

The next step 106 is to load the fixture 16 into the roll-over station 20 which is shown in FIG. 1 as a first or upright position. The fixture enters the roll-over station 20 by rolling off the transport system 14 and into the inlet 50 of the roll-over station 20. Once the fixture is advanced to this position, another fixture 16 on the transport system 14 is advanced so that it can be staged and ready to be processed at the next available pour cycle.

The next step 108 is to secure the fixture 16 to the roll-over station 20. This may be accomplished by using an automated locking system having clamps and sensors that communicate with the computer 38. This securing step 108 holds the fixture in place when it is rotated 180 degrees before the fill cycle.

The next step 110 is to connect the He source 22 to the mold segments 18 or mold 76. This step provides the supply of inert gas, such as He, to the mold 76 so that a constant supply of He can be delivered at predetermined pressures and predetermined flow rates. This results in a controlled He infusion process which can be adjusted based on the mold's geometry. The He source 22 can be controlled by the PLC 36 or computer 38, and thus the He delivery process can be specifically controlled so as to yield a certain result within the mold 76. For example, for a mold 76 with many mold segments 18, the rate of gas delivery to the mold's cavity can be controlled so as to have the rate of infusion of the inert gas calculated to exhaust Oxygen from the cavity of the mold in the best possible way.

The next step 112 is to inject He into the bottom of the mold segments. This step starts the process of removing $O_2$ particles from the base of the mold cavity.

The next step 114 is to flush the mold segments 18 with He under a predetermined pressure and flow rate so as to create an environment of $O_2$-free mold segments, along with any other particles that may be present in the cavity of the mold segments. This is the step where the inert gas source system 22 continuously works to flush the entire cavity with inert gas sufficient to evacuate all $O_2$, and penetrate the porous walls of the mold to form a barrier layer of inert gas on the surface of the inner wall cavity. This barrier layer of inert gas helps the thermal cooling performance as it has high thermal conductivity. A goal of this step may be to provide total He gas saturation within the mold cavity 76. Another goal is to provide targeted He gas delivery to specific sections within the mold cavity, and that can be accomplished by the inert gas source system 22 working in concert with, for example, a manifold delivery system. (See FIG. 6.)

The next step 116 is to rotate the fixture 16 using the mold roll-over station 20 to a second or inverted position 58. By rotating the fixture 180 degrees, this facilitates an anti-gravity molten metal fill process. Constant inert gas pressure may be applied during this roll-over process so that positive pressure is maintained within the cavity to aid in keeping $O_2$ for reentering the mold cavity. This process will help keep the mold cavity saturated with inert gas before and during the mold fill process.

The next step 118 is to connect the fixture 16 to the low-pressure furnace 24. This can be accomplished by the turret 48 indexing axially in a direction opposite of arrow 54. The turret 48 indexes to the point where it fully connects to the nozzle 52 which extends outward from the body of the furnace 24. Once the nozzle 52 is connected to the turret 48, this becomes the metal pour fill position and such is maintained during the pour fill cycle.

The next step 120 includes injecting into bottom 78 of fixture 16 molten metal 80 using a counter gravity filling process where molten metal 80 is delivered in an $O_2$-free environment. The counter-gravity filling process results in introducing molten metal 80 in the bottom 78 of the sand mold using a low-pressure system furnace delivery system. The pressure range employed in this counter-gravity filling process could be in the range of 5 psi to 20 psi and the flow rate could be in the range of 5 to 25 pounds/second. By introducing the molten metal 80 using this counter-gravity methodology, the molten metal 80 will displace the He within the cavity as the pressurized molten metal traverses from the bottom of the cavity 78 and makes its way upward, against gravity, through the internal spaces 82 of the cavity. As the metal 80 continues to displace the He and travel upward against gravity, the He is exhausted out a degassing valve 222 near the top of the fixture 16. (See FIG. 4) This process continues until a predetermined amount of metal 80 has been introduced in to cavity such that the cavity has been filled.

Figure 4:
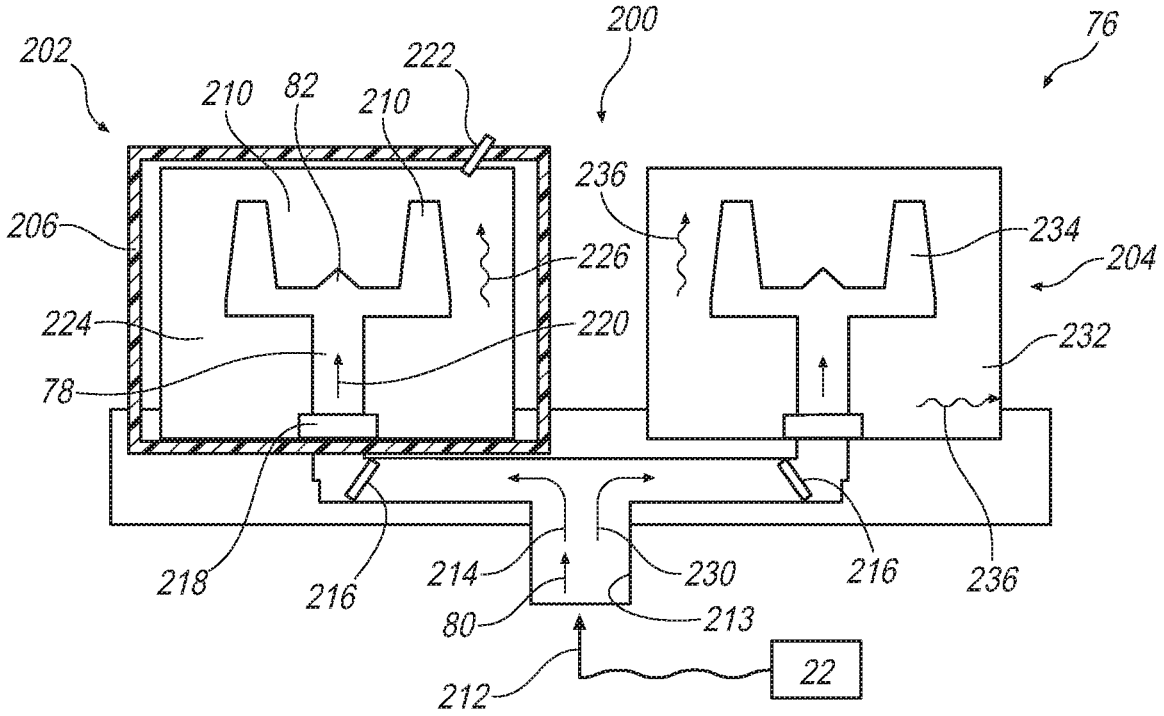
FIG. 4 is an illustration of an alternative sand casting mold for making metal parts using a mold having a sealed compartment that can be injected with Helium.

The next step 122 is to continue injecting metal using low-pressure counter-gravity cycle to form a casting part 12. This is improved by the deployment of He in the cavity which improves fluid flow. The He further reduces turbulent metal flow within the cavity which permits a more rapid fill rate because, in part, there is less push back because the air has been removed from the cavity. This step includes the low-pressure furnace 24 delivering molten metal 80, aluminum for example, but other metals are contemplated by this disclosure, through the furnace nozzle 52 which in turn directs the metal 80 to the mold cavity 76. FIG. 4 illustrates an example of a cross-section of one such mold cavity 76, which is discussed further below. Metal 80 enters the bottom of the cavity and is forced up and through the cavity. This fill process continues for a predetermined period of time which may be controlled by the computer 38, or a separate fill system having its own sensors, valves, and control logic.

The next step 124 is to stop filling the mold with molten metal 80 when a mold full signal is generated by a mold fill sensor 84. The sensor 84 may be situated near the top 86 of the mold. The sensor may communicate with the PLC 36, the computer 38, and/or a separate fill system. The fill sensor 84 may be on board the fixture 16, as is shown in FIG. 1, or inside the mold cavity 76, or the sensor 84 may be positioned elsewhere relative to the casting system 10. Stopping the flow of metal to the mold may be accomplished by other means, which are contemplated by this disclosure.

The next step 126 of the casting process may include rolling the fixture 16 back to the first position 26. This would be the same orientation as the fixture 16 had when it entered the roll-over station 20 at the beginning of the fill cycle. See FIG. 1. By contrast, it will also be appreciated that this step may be avoided and the fixture with the newly molded casting part 12 may be kept inverted, as is shown in FIG. 2, and then exited from the roll-over station 20. The decision how to orient the fixture at this stage of the process 90 provides for a flexible method of operation.

The next step 128 is to disconnect fixture 16 from furnace 24. This can be accomplished by retracting the turret 48 in the direction of arrow 54 so as to cause the nozzle 52 to disengage the inlet 50 of the turret 48. It will be appreciated that this step may be accomplished using a drive system 88 that may be on-board or external to the roll-over station 20. The drive system 88 is operable to control the indexing of the turret 48 relative to the base 44 at predetermined periods of the metal pour cycle.

The next step 130 is to disconnect the He from fixture 16 so as to no longer deliver pressurized He to the fixture 16. This may be accomplished manually or by the system 10 being automated in this regard so long as the inert gas source system 22 is no longer delivering a supply of gas to the cavity. The inert gas system 22 may include a supply tank, lines, valves, sensors, gauges, and its own controller.

The next step 132 is to remove the fixture 16 from roll-over station 20. This may be accomplished in several ways, one of which could include actuators propelling the fixture 16 in a direction 62 away from the roll-over station 20 so as to advance the fixture 16 towards the second line 28 which could also be referenced as a cooling conveyor.

The next step 134 is to advance the fixture 16' to the cooling conveyor which embodies the second line 28 for the final processing of the fixture. Once the fixture 16' is securely positioned on the cooling conveyor 28, the roll-over station 20 is now free to accept another fixture 16 that in turn can be loaded, and thus a new mold fill process can begin once it is has been properly positioned.

The next step 136 is to introduce chill cycle to the fixture 16' and thus the casted part 12 that is now curing within the fixture 16'. By employing chillers at this stage, the casted part 12 will begin cool quicker which results in improved part characteristics. The chill cycle may be accomplished by the use of chillers 30 that are shown in FIGS. 1 and 2 in schematic form where the chillers 30 may be placed in close proximity to the cooling conveyor 28. One or more chillers 30 may be deployed in this casting system 10. The chillers 30 may encapsulate the fixture 16' as the fixture 16' traverses along the conveyor, or they may be lesser configured as is shown in the FIGS. The chillers may be flexible and programmable so as to exert a predetermined amount of cooling capacity so as to meet the cooling preferences on any given fixture 16' as it traverses the conveyor. For example, if a fixture 16' is hosting a casting part 12 that has a large dimensional characteristic, then the chillers 30 may be programmed to deliver a high cooling capacity so as to cool the casting part 12 at a preferred rate of cooling. By contrast, if the fixture 16' is hosting a smaller part 12 to be casted, then the chillers 30 may be programmed to deliver a lower cooling capacity.

The next step 138 is to shake out the part 12 from the fixture 16. This is done after the chillers 30, if any, have completed their cooling cycle and thus the part 12 is ready to be broken away from the fixture and the sand molds therein. The shake out step 138 may be accomplished using conventional means in the industry. However, one variant here is that the fixture 16' will be preserved and repurposed so as to be deployed again in another casting process 90. Thus, the shake out process 138 contemplates a recovery system for the just used fixture 16', a procedure for separating out the dirty sand, and for then advancing the newly casted part 12 to a finishing station.

The next step 140 is to repeat steps 100-138 to form another casting part 12. This casting process 90 contemplates employing the casting system 10 over and over again so that a continuous mold line can operate at varying capacities. For example, prototype mold casting runs can be envisioned with the present system because it is flexible in that fixtures 16 can be loaded on to the transport system 14, all the while the parts 12 to be formed can be of different sizes and shapes. The computers 38 and PLCs 36 may permit selective programming for each fixture 16, which in turn allows for the mold fill cycle to be uniquely controlled, and the chill cycle to be uniquely controlled, all based on the desired characteristics for a particular casted part 12. The mold fill cycle can contemplate steps 102-132, while the chill cycle can contemplate steps 134-136.

Another example of the flexibility of the present system is that small prototype runs may be intermixed with large scale production runs. This can be accomplished because each fixture 16 may have its own mold parameters 140, 142, and so on. Each mold parameter may be a unique set of instructions, data sets, characteristics, and the like, that are particular to the casted part 12 that is to be casted. For example, one mold parameter 140 could be specific instructions regarding the part to be manufactured, part size, target weight, inert gas type to be delivered to the cavity, rate of gas delivery, pressure rate of gas delivery, cycle time, mold fill cycle time target rates, metal type, chill cycle times, target casted part material properties, etc. Any bit of information that may be important, specific, and/or unique to the part 12 to be casted could be contemplated as a mold parameter 140, 142. The mold parameters 140, 142, may be saved in a storage system that is connected with the computer 38 and/or housed in the cloud.

It will also be appreciated that on large scale casting production runs, the casting system 10 can be deployed where the identical casted part 12 can be casted for extended periods of time, such as days, weeks, months, even years. If a part changeover is later desired, then the mold parameters 142 for the next desired part can be set up and programmed, and because the system 10 is flexible, the production line can be easily transitioned to casting another part as desired.

FIG. 4 discloses an illustration of but one sand casting mold 76 for making metal parts using the casting system 10 and casting method 90 set forth herein. The casting mold 76 may have a sealed mold compartment that can be injected with inert gas such as Helium as well as un-unsealed mold compartment. It will be appreciated that the molds 76 used with the casting system 10 may have only one cavity, or more than one cavity, which is style illustrated. It will also be appreciated that the cavity 76 may have a plurality of cavities, all of which could be sealed or unsealed. For demonstrative purposes only, FIG. 4 shows both a sealed and an unsealed (full of air) cavity.

The sand casting mold 76 includes cross-sections 200 with an exemplary mold cavity section 202 having a sealed configuration and a non-sealed 204 cavity configuration. The sealed cavity section 202 includes a seal 206 that creates a sealed environment for surrounding and segregating the permeable sand mold 208 from the rest of its environment. The seal 206 may be a bag, liner, or other device that is operable to withstand the internal operating characteristics that are present in the casting environment. The seal 206 encapsulates the sand mold 208 and is operable to keep air out while maintaining inert gas inside the liner during the mold pour cycle. The seal is capable of withstanding pressures in the range of 5 psi to 50 psi. Within the center of the sand mold is the cavity 210 which takes on the form of the casted part 12 that is to be formed in this foundry process.

Inert gas 212 such as, but not limited to He, is introduced at an inlet 213 into a mold gate and it traverses along a path 214 to where an inlet valve 216 may control the flow of gas 212. Gas 212 passes past the valve 216 through a seal member 218 that is positioned adjacent a lower portion of the liner 206. Gas 212 then is forced in the direction of arrow 220 to where it permeates and saturates the cavity 210. A degassing valve 222 is positioned at an opposite side of the sealed liner 206. Within the sealed liner 206 is an internal environment 224 wherein gas particles 226 are forced up and out of the environment through the degassing valve 222. Before the internal environment 224 is flushed with an inert gas, it contains atmospheric contaminates such as $O_2$, and others, which can be flushed out with the aid of the pressurized inert gas system 22. The gas 212 flow and pressure rates may be controlled by the system 22 so as to achieve a desired part performance.

With continued reference to FIG. 4, an air cavity section 204 is depicted that does not have a sealed liner 206. This is considered an air mold that is operable to deploy other aspects of the inert gas infusion system disclosed herein. In particular, gas, such as He, traverses along a path 230 and through a valve 216 and onward up into the permeable sand mold 232 and the cavity 234. The gas 212 continues to fill the sand mold 232 as long as the valve 216 remains open. As the gas 212 enters the sand mold 232 is forces particles 236 up and out of the sand mold 232 in many directions. Because no seal liner 206 is present in this embodiment, the atmospheric pressure will permit $O_2$ particles to reenter the sand mold 232 if a positive pressure is not maintained via the inert gas supply system 22. Thus, maintaining positive He pressure will aid in keeping impurities out of the sand mold 232 during the molding cycle.

Figure 5A:
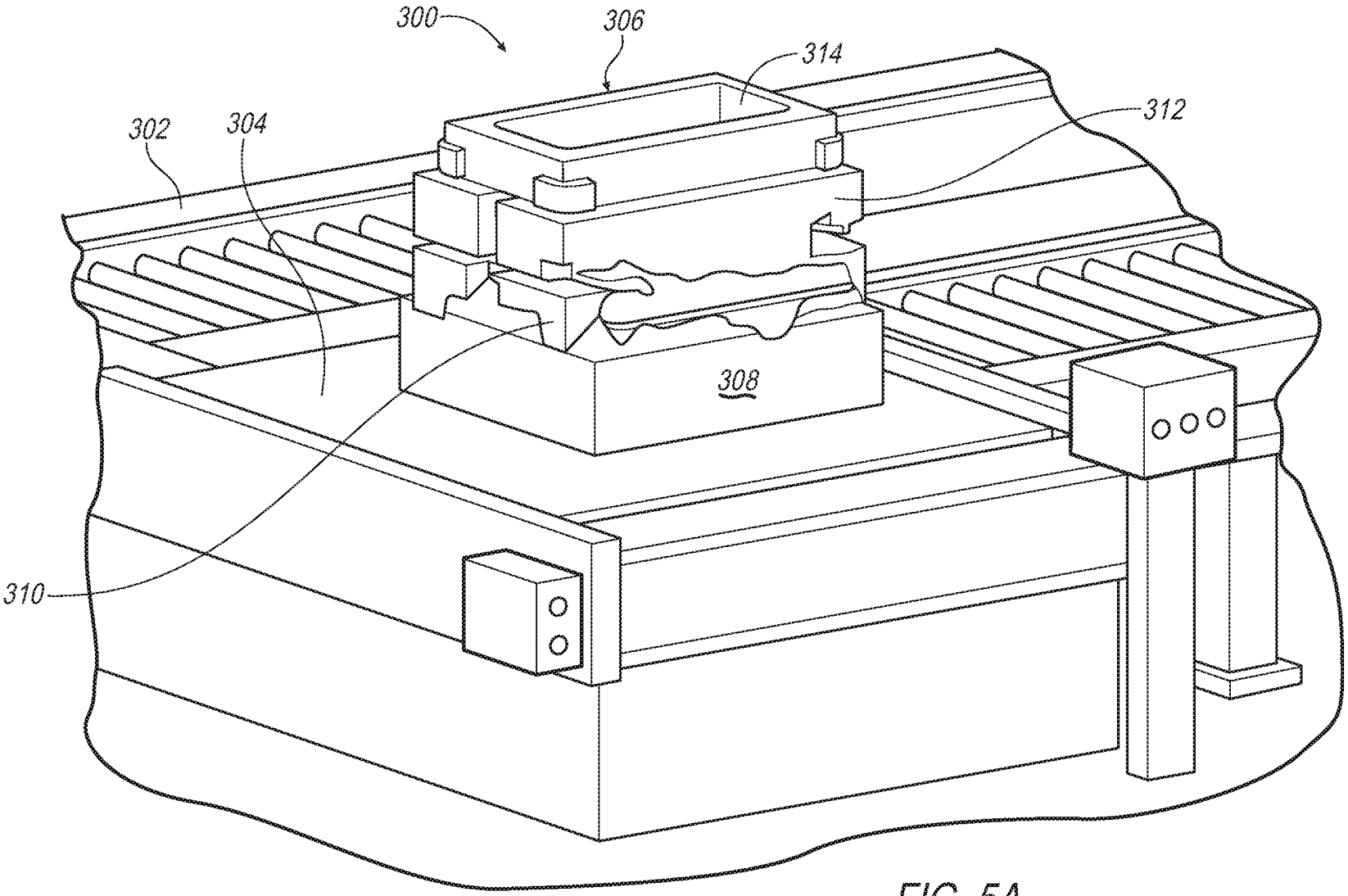
FIGS. 5A-5C are schematic representations of an alternative low-pressure casting system having a chamber environment deploying a mold placed in a chamber that is injected with Helium to form a part in an $O_2$-free environment.
Figure 5B:
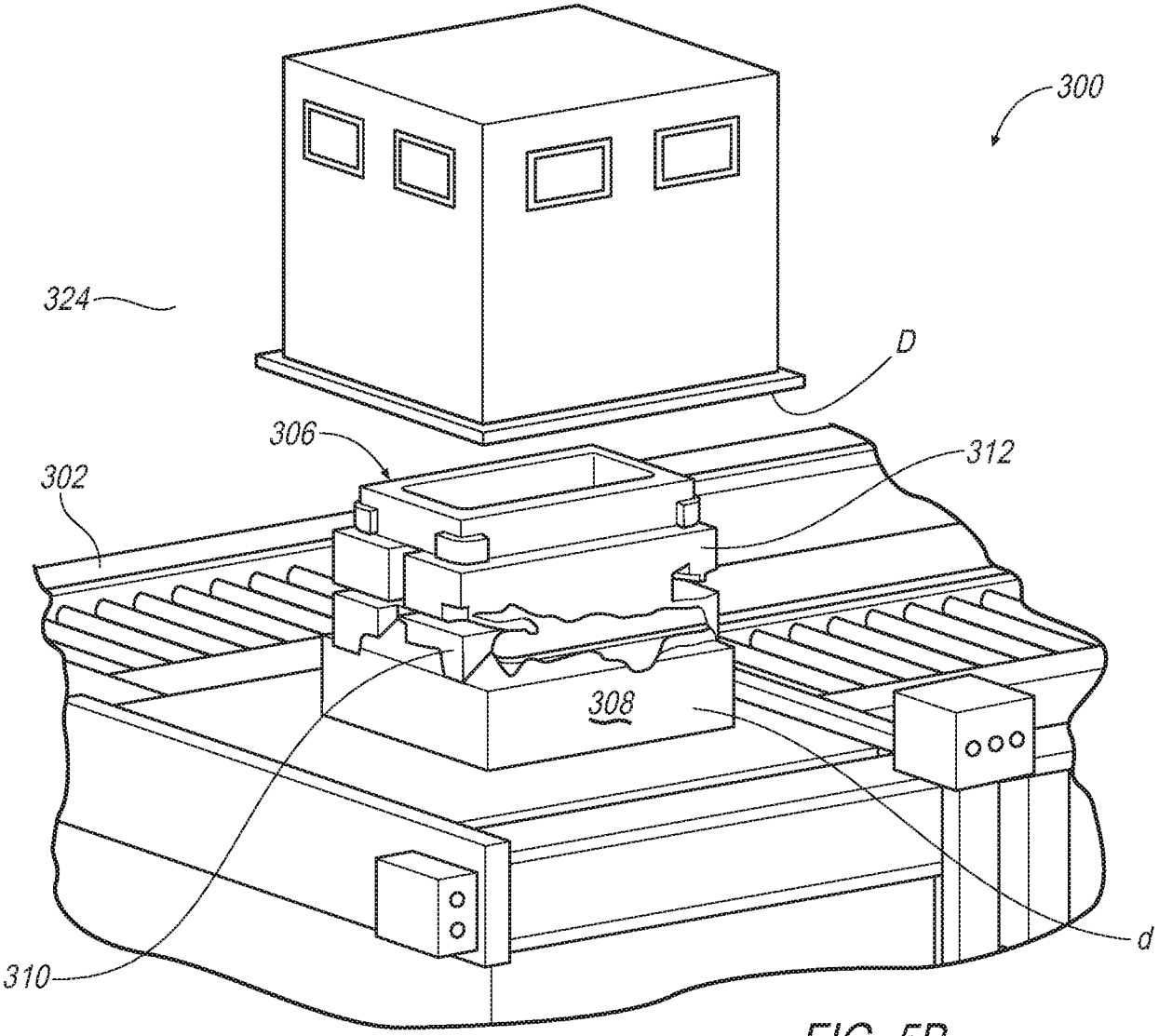
Figure 5C:
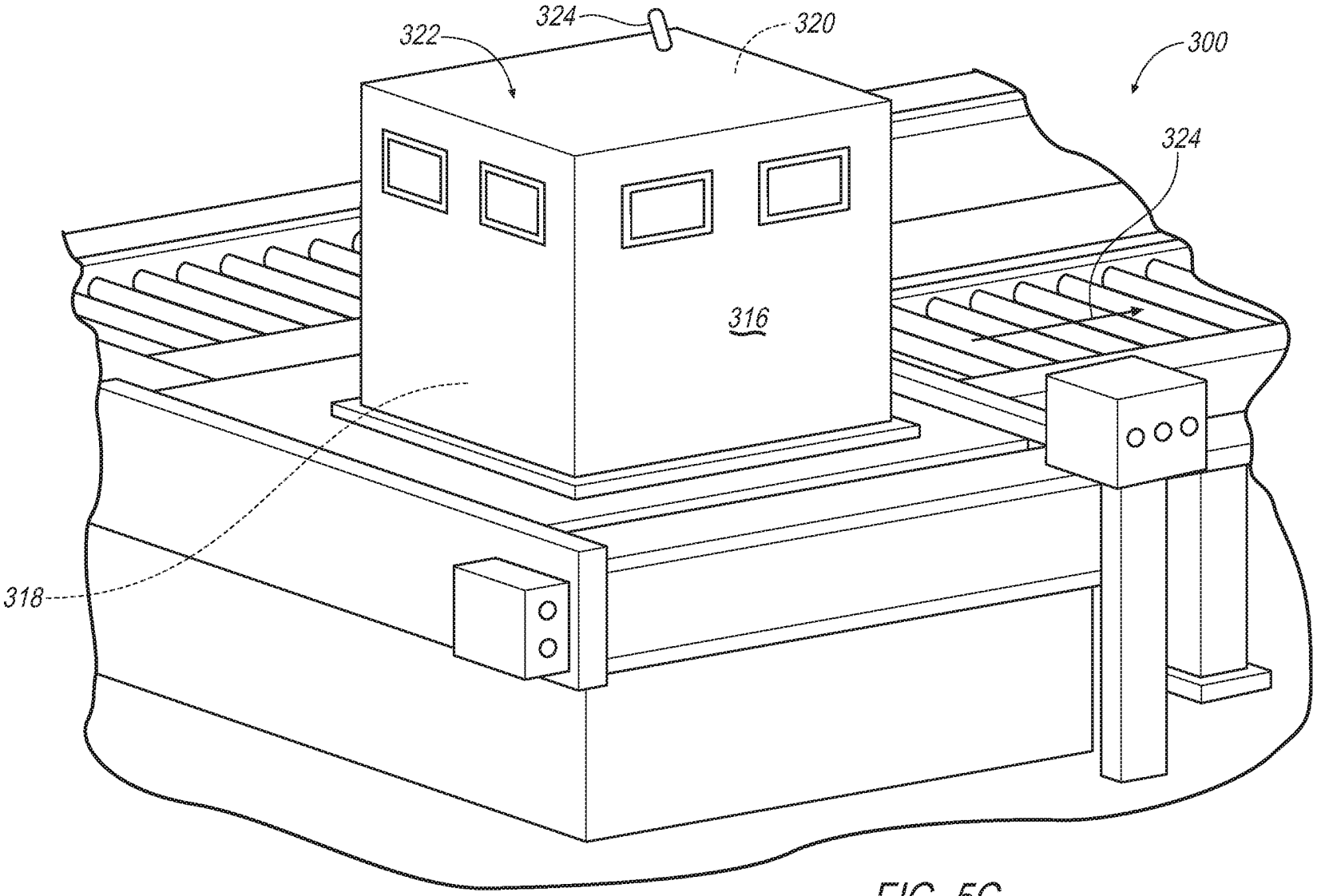

FIGS. 5A-5C disclose schematic representations of an alternative low-pressure casting system 300 using a mold placed into a chamber that is injected with Helium to form a part in an $O_2$ free environment. Referring to FIG. 5A, this alternative casting system 300 includes a mold transfer line 302 and a staging area 304 for preparing a mold 306 for casting a part. The mold 306 may be a permanent or semi-permanent type sand casting mold. The mold 306 may have a base or fixture 308, a drag 310, a cope 312, and a pour cavity 314.

With reference to FIG. 5B, a cover 316 is provided and presented over the top of the mold 306. It has an internal dimension D that is slightly larger than the outer dimension d of the fixture 306 so as to permit the cover 316 to be lowered and mated to the mold 306 whereby minimal gap is presented between these two structures. FIG. 5C illustrates the cover 316 having been completely positioned in place over the top of the mold 306 so as to form a sealed chamber 318. The sealed chamber 318 creates an enclosed environment 320 for the mold 306 to reside, and for an inert gas to be inserted. Once the cover 316 is in place, the mold fixture 322 (the mold 306 and the cover 316 combined), is advanced in the direction of arrow 324 to a mold fill station where an inert gas is introduced to the sealed chamber via an inert gas source system 22. Once the $O_2$ particles have been flushed via a degassing valve 324 from the sealed chamber 318 with an inert gas, a low-pressure furnace 24, or other furnace system, begins to fill the mold 306 with molten material. It will be appreciated that aluminum castings, or other materials, may be used in this process.

Figure 6:
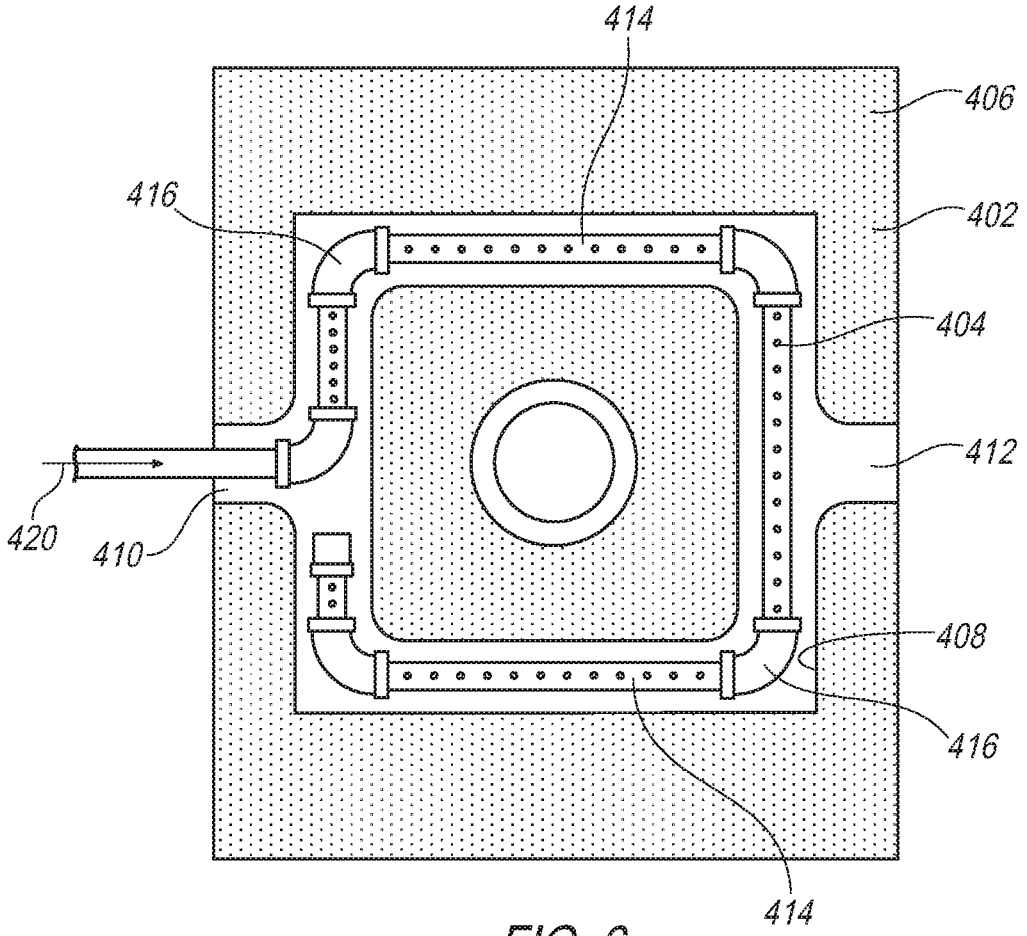
FIG. 6 is a schematic diagram of an alternative metal casting system that uses a manifold system for delivering gas, such as Helium, into a lower portion of a mold during the casting process.

FIG. 6 discloses a schematic diagram of an alternative metal casting system that uses a manifold system 400 for delivering gas such as Helium in to a mold during the casting process. The manifold system 400 may be deployed in the casting system 300 that is shown in FIGS. 5A-5C. The manifold system 400 includes a sand mold drag 402 and a piping system 404. The drag 402 has a body 406, a recessed channel 408, an entrance 410 and an exit 412. The recessed channel is deep enough to receive the piping system 404. The recessed channel 408 provides a void for also delivering inert gas to the cavity of the mold.

The piping system 404 includes a plurality of pipes 414 and elbows 416, preferably made of metal, that are connected and progress through the recessed channel 408. The pipes 414 include gas openings 418 that permit inert gas to be released out of the piping system 404 and directed towards the mold cavity. Inert gas flows in to the drag 402 in the direction of arrow 420 and is routed through the piping system.

Figure 7:
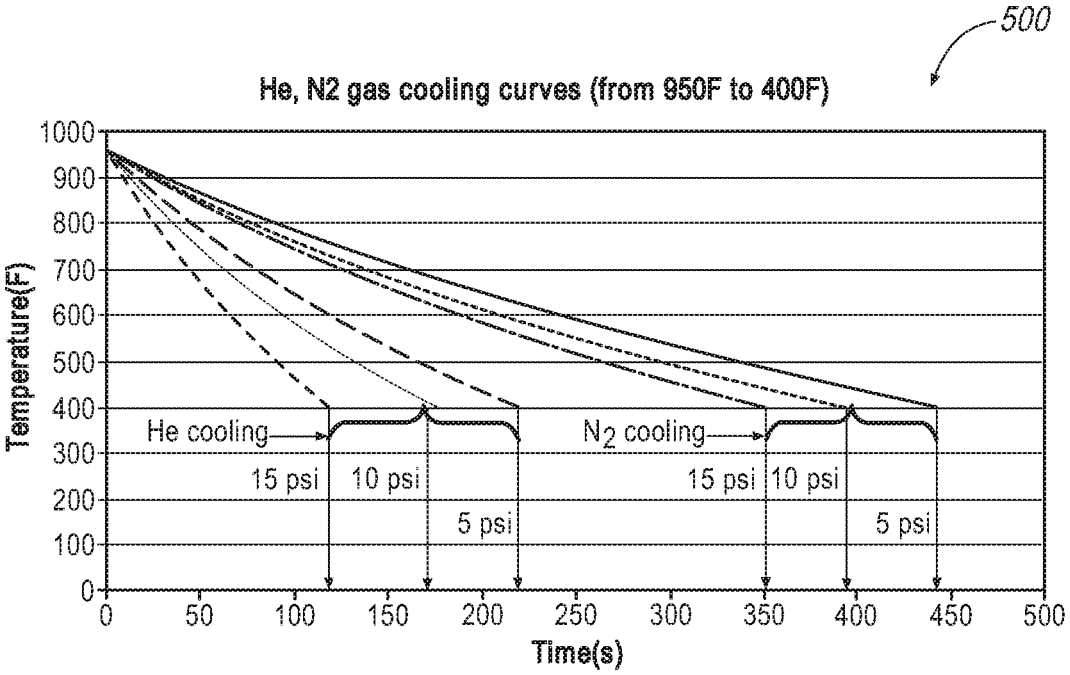
FIG. 7 are He and Nitrogen [$N_2$] gas cooling curves showing casting cooling times relative to pressure.

FIG. 7 discloses He and $N_2$ gas cooling curves 500 showing casting cooling times relative to pressure. In these figures graphs are depicted via curves showing furnace low-pressure injection rates of 5 psi, 10 psi, and 15 psi. The casting system 10 operates well within these pressure ranges. The Helium cooling affect also measurably reduces aluminum dendrite cell spacing [DCS], an equivalent technical term for commonly used secondary dendrite arm spacing [SDAS]. The cooling curves 500 illustrate performance graphs that show He cools much faster than $N_2$, the result of which is that faster production cycle times can be accomplished.

The efficiency of Helium as a cooling gas and the impact on the aluminum metallurgy has been evaluated under two very distinct test environments: [1] measure the cooling rate of Helium and Nitrogen on a preheated slug of aluminum, and [2] measure the cooling rate of Helium and Nitrogen in an encapsulated sand mold environment when filled with molten aluminum.

The first test was to measure the cooling effects of Helium and Nitrogen gas in a close-to-open system where a preheated aluminum specimen was surrounded by the ceramic fibers. The highly permeable ceramic fibers generated virtually no back pressure in the system. The cooling curves of the preheated 6061 aluminum cylinder from 950 F to 400 F under different cooling gases and different gage pressures showed: [1] the mass flow rate of Helium is always higher than that of Nitrogen under any pressure applied, and [2] the cooling rate of the preheated metal increases with cooling medium mass flow rate. The results are consistent with the statistical thermodynamics gas theory. The gas theory predicts that Helium molecules have a slightly lower heat capacity than Nitrogen [by ~30%], but travel much faster [by ~160%] than Nitrogen under any given temperature because of its lower molecular weight than Nitrogen (4 to 28). For a given gage pressure [z overall pressure differential] there are significantly more Helium molecules available to remove heat than Nitrogen. Consequently, this gas cooling efficiency test demonstrates very clearly the measurably higher cooling rates for Helium gas when compared to Nitrogen [air].

In the second test, Helium and Nitrogen gas was applied to a sealed sand mold before and during casting solidification. In addition, a mold was poured without any gas flow simulating a conventional sand mold filling environment. The cooling curves decidedly show the cooling effect of Helium gas compared to Nitrogen gas as well as a comparative cooling curve for a conventionally solidified mold environment. The thermal data strongly suggests that Helium cooling will cause a DCS reduction based on the well-known relationship between aluminum alloy DCS and local solidification time.

It will be appreciated that the aforementioned method and systems may be modified to have some components and steps removed, or may have additional components and steps added, all of which are deemed to be within the spirit of the present disclosure. Even though the present disclosure has been described in detail with reference to specific embodiments, it will be appreciated that the various modifications and changes can be made to these embodiments without departing from the scope of the present disclosure as set forth in the claims. The specification and the drawings are to be regarded as an illustrative thought instead of merely restrictive thought.

What is claimed as new and desired to be protected by Letters Patent of the United States is:

1. A casting system comprising:

a transport system having a first portion and a second portion;

a fixture slidable relative to the transport system;

a mold having a first portion and second portion that are supported by the fixture, a pour cavity is located on top of the second portion for receiving molten metal;

a cover is located over the mold and is configured to rest against the fixture to form an enclosed environment;

a roll-over machine that is operable to receive the fixture;

a furnace; and an inert gas system that is configured to deliver pressurized gas to the enclosed environment during delivery of metal to the mold.

2. The casting system of claim 1, further comprising a chiller that cools one of the mold or the fixture.

3. The casting system of claim 1, further comprising a seal located between the cover and the fixture.

4. The casting system of claim 1, further comprising a shake out mechanism for separating a casted part from the mold.

5. The casting system of claim 1, wherein the transport system includes a roller system, the roller system is operable to support the fixture and enhance movement of the fixture along a surface of the transport system.

6. The casting system of claim 1, wherein the transport system includes a motor, the motor is operable to cause fixtures that are placed on top of the transport system to move along a surface of the transport system.

7. The casting system of claim 1, wherein the roll-over machine includes a receiver that is operable to receive the fixture, a securing mechanism that is operable to secure the fixture relative to the roll-over machine, a rotational mechanism for rotating the fixture at least 180 degrees, and an exit portion that is operable to remove the fixture to a second portion of the transport systems.

8. The casting system of claim 1, wherein the second portion of the transport system has at least one chiller, said chiller is operable to impart a cooling gas to one of the mold or the fixture.

9. The casting system of claim 1, further including a mold fill sensor for sensing when the mold has been filled with molten metal to a predetermined level.

10. The casting system of claim 1, wherein the gas delivery system is configured to deliver inert gas to purge the enclosed environment before metal is delivered to the mold.

11. The casting system of claim 1, further comprising a gas manifold system that is part of the casting system, the gas manifold is connected to the inert gas system.

12. A casting mold system for making a casting comprising:

a station having a first portion and a second portion;

a support structure that can be positioned at the station;

at least one sand mold segment for integration with a mold cavity;

a vent system operable to provide introduction of inert gas into the mold cavity;

a seal between the support structure and the mold segment, the seal and the support structure are configured to provide an enclosed environment;

a metal delivery passage; and an inert gas delivery system configured to deliver pressurized gas to the enclosed environment during delivery of metal to the mold.

13. The casting system as claimed in claim 12, further comprising a low-pressure furnace that can be selectively connected to a mold cavity.

14. The casting system as claim in claim 12, wherein the inert gas delivery system is configured to control volume and flow rate of inert gas to the mold cavity, the gas delivery system including a one of a computer or controller to control the flow of inert gas.

15. A casting system for making a casting comprising:

a pouring station having a first portion and a second portion;

a mold having a mold cavity;

a support structure for delivering the mold to the pouring station;

an inert gas delivery system that is configured to deliver pressurized gas to the mold cavity during delivery of molten metal to the mold; and a metal delivery passage for delivering the molten metal into the mold cavity.

* * * * *